United States Patent [19]

Wada

[11] Patent Number: 4,982,462

[45] Date of Patent: Jan. 8, 1991

[54] MEDICAL ATTENDANCE BATHTUB BED

[76] Inventor: Mikuni Wada, 3-911, Hirabari, Tenpaku-ku, Nagoya-shi, Aichi-ken, Japan

[21] Appl. No.: 499,750

[22] Filed: Mar. 27, 1990

[30] Foreign Application Priority Data

Mar. 28, 1989 [JP] Japan ..... 1-35036[U]

[51] Int. Cl.[5] ..... A61H 33/02; A47K 3/12

[52] U.S. Cl. ..... 4/546; 4/559; 4/569

[58] Field of Search ..... 4/144.1, 144.2, 144.3, 4/144.4, 546, 443, 559, 615, 616, 617, 618, 567, 568, 569, 570; 604/385.1, 378, 358, 443, 322, 347, 348, 349, 351, 353

[56] References Cited

U.S. PATENT DOCUMENTS 3,701,170 10/1972 Bond ..... 4/570

4,791,686 12/1988 Taniguchi ..... 4/144.3

FOREIGN PATENT DOCUMENTS 57-81344 5/1982 Japan .

*Primary Examiner*—Henry J. Recla

*Assistant Examiner*—David J. Walczak

*Attorney, Agent, or Firm*—Armstrong, Nikaido, Marmelstein, Kubovcik & Murray

[57] ABSTRACT

A medical attendance bathtub bed in which a person, such as a patient or an old person, who must always be laid in a clean bed, is laid in a bed which becomes a bathtub. In case of discharging, the patient's pubic region and anus are covered by a detachable stool in a sealing state, cleaning liquid is injected from a cleaning liquid injector provided on the inner face of the detachable stool to clean the predetermined portions, and the cleaning liquid, including contaminants, is drained to a sewage hole from a drain tube attached to the detachable stool to eliminate discharge sound, offensive odor, etc. externally.

2 Claims, 9 Drawing Sheets

MEDICAL ATTENDANCE BATHTUB BED

BACKGROUND OF THE INVENTION (1) Field of the Invention

This invention relates to a medical attendance bathtub bed for use in sleeping, bathing, medical care, etc. of a person who must be always laid in bed such as a handicapped person or a bedridden old person in a ward or a household.

(2) Description of the Prior Art

People who are always laid in bed as described above do not have any freedoms of daily getting up and go to bed and hence all need helpers or family attendants, and should lead a recuperation by the people's medical attendance or nurse. Problems of cleanliness of patient's body and evacuation are serious subjects for these patients and attendants. Regarding their bathing, a bath room equipped with a lift type bathing apparatus is installed in one room of a large hospital provided with regular facilities, and a patient who exhibits a light symptom can easily take a bath. When the hospital has a number of in-patients, the patient is still allowed to have a bath only several times per month. Since the patient must reciprocate between a sick room and a bath room, a heavily handicapped patient cannot easily have a bath. Since such a facility is difficult to be installed in a small-scale hospital or a household, the patient is bathed in a simple bathtub made of synthetic resin by holding the patient by a helper or an attendant, and since it is very heavy work, it is impossible to let the patient have a bath frequently.

There is a bathtub bed in which a mattress is detachably provided in a bathtub in order to easily let a patient have a bath in such a case (Refer to Japanese Patent Laid-open No. Sho 57-81344). This bathtub bed becomes a bed in a state that a mattress is contained therein and also becomes a bathtub by removing the mattress and supplying hot water thereto. A bare patient is placed on a hammock-shaped elevation net and hung down in the bathtub to which the hot water is supplied, washed and cleaned at his or her body, the elevation net is then lifted, hot water in the bathtub is drained, moisture on the body, net and bathtub is removed, dried, the mattress is returned into the bathtub, and the patient is again moved down to be laid on together with the net. Thus, the bathing problem of the bedridden patient can be solved, but there is still retained a problem of patient's discharge. More specifically, it is common to bring a diaper into contact with such a bedridden patient. In case of exchanging the diaper, since patient's waist is opened, offensive odor is generated and the other circumstances arise to cause a nurse, an attendant, adjacent patents in case of a large-scale sick room, and visitors to have to take an attention. Thus, it is remarkably inconvenient in view of mental hygiene. When the patient uses a simple movable flush lavatory near his bed by the aid of a nurse without contact with a diaper, discharge sound and offensive odor cannot be avoided to similarly cause them to be given by unpleasant feeling.

SUMMARY OF THE INVENTION

This invention provides a medical attendance bathtub bed in which an elevation net telescopic in hot water in a bathtub for holding a human body of a patient or the like is provided in the bathtub bed in which a mattress is detachably provided, a drain hole for used hot water is formed at the bottom of the bathtub bed, a detachable stool capable of covering patient's pubic region and anus in a sealing state is attached to the human body placed on the elevation net, and the drain section of the cleaning liquid of the detachable stool is connected to the drain hole of the bathtub bottom. Further, in the medical attendance bathtub bed, an injector for injecting cleaning liquid to the patient's pubic region and anus is disposed inside the detachable stool, and a cleaning hot water hose is connected to a hot water supply port formed at the injector. Thus, it is a primary object of this invention to provide a medical attendance bathtub bed in which cleaning liquid of suitable temperature is supplied from the hot water supply hole to be injected from the injector to thereby clean the patient's pubic region and anus, and the cleaning liquid including contaminants is discharged from the drain hole at the bathtub bottom into the detachable stool to automatically and rapidly clean the patient's waist portion covered with the detachable stool.

Another object of this invention is to provide a medical attendance bathtub bed which can prevent discharge sound and offensive odor even during patient's stooling from externally leaking by covering the part of the patient's waist portion including patient's pubic region and anus in a sealing state.

A further object of this invention is to provide a medical attendance bathtub bed which can prevent offensive odor and contaminant liquid from externally leading even during cleaning work by covering the part of the patient's waist portion including patient's pubic region and anus with a detachable stool in a sealing state.

Still another object of this invention is to provide a medical attendance bathtub bed which eliminates generation of offensive odor from the periphery of the bed by discharging the cleaning liquid including contaminants from the drain section of the detachable stool directly to a sewage hole through the drain hole of the bathtub bottom.

Still another object of the invention is to provide a medical attendance bathtub bed which can let a patient have a bath subsequently to the removal of a detachable stool by detachably composing the detachable stool with respect to the bathtub bed.

DESCRIPTION OF THE PREFERRED EMBODIMENTS

An embodiment of a medical attendance bathtub bed according to the present invention will be described with regard to arrangements thereof with reference to the accompanying drawings.

Figure 2:
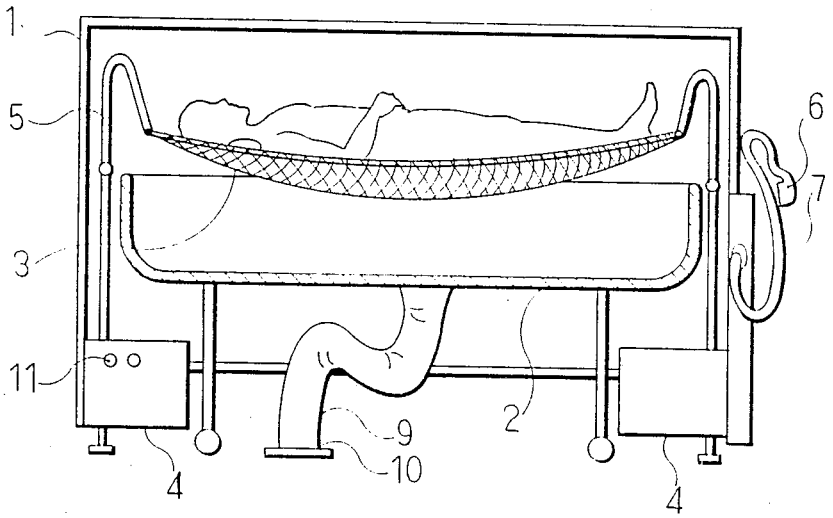
FIG. 2 is a partly cutout front view showing the state that the elevation net is lifted in FIG. 1.
Figure 3:
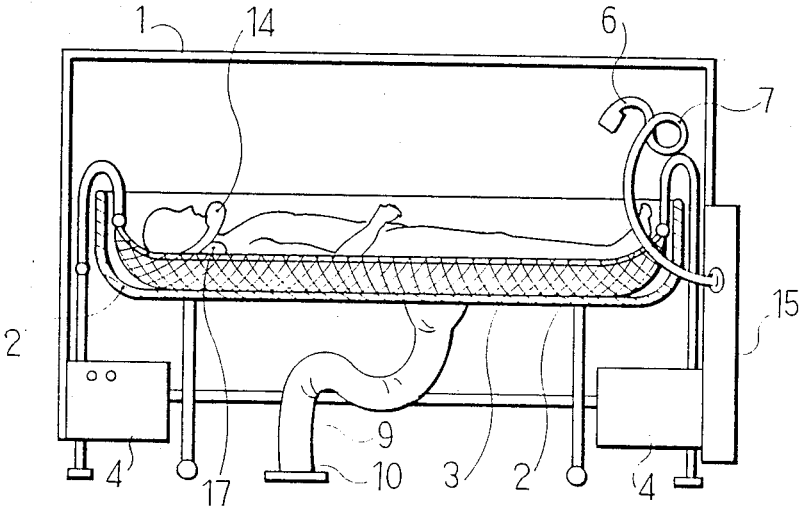
FIG. 3 is a partly cutout front view showing the state that a patient is being bathed in such a manner that a patient's head is floated by a floating ring and a rubber pillow for safety.
Figure 4:
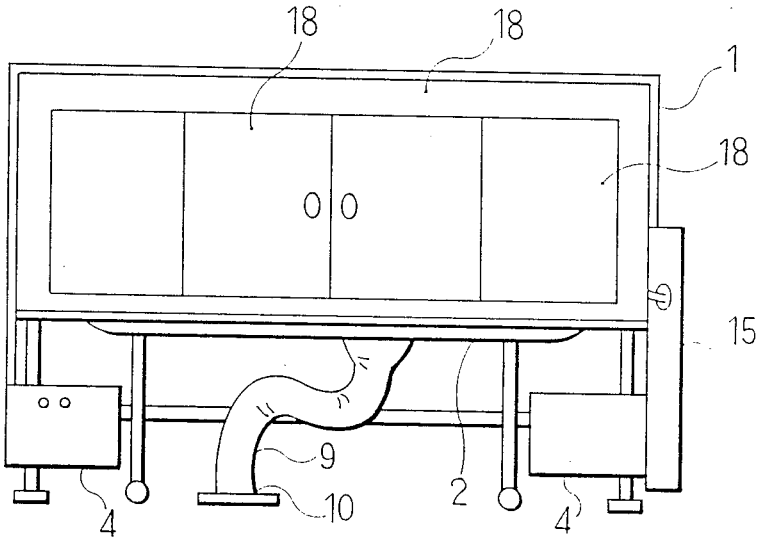
FIG. 4 is a front view showing the state that sliding doors are closed to shield a patient's body.
Figure 5:
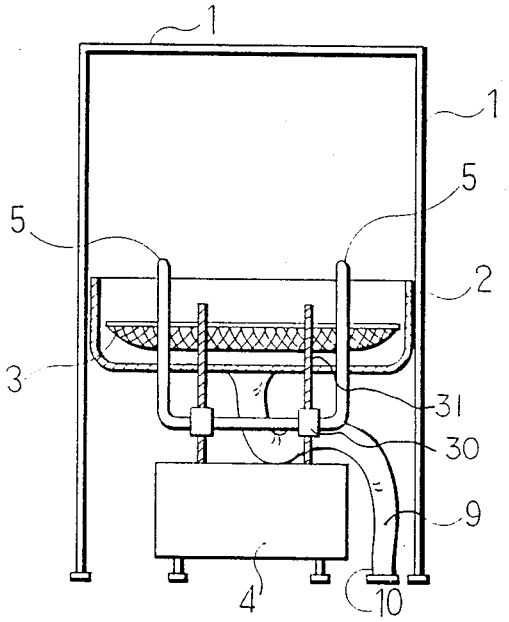
FIG. 5 is a partly cutout side view in the state that the side face plate of an outer frame is removed.
Figure 6:
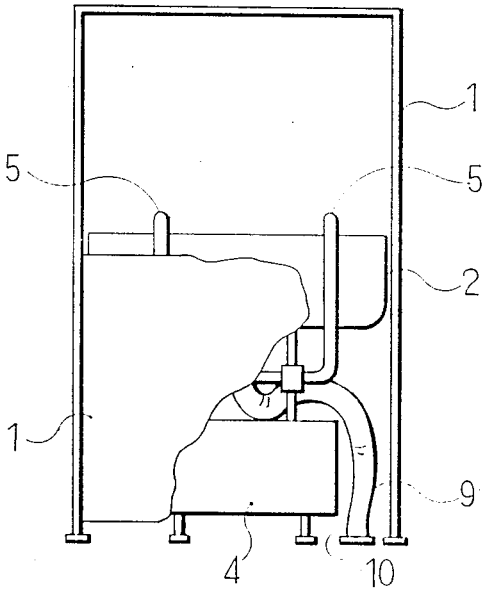
FIG. 6 is a partly cutout side view and in section.
Figure 7:
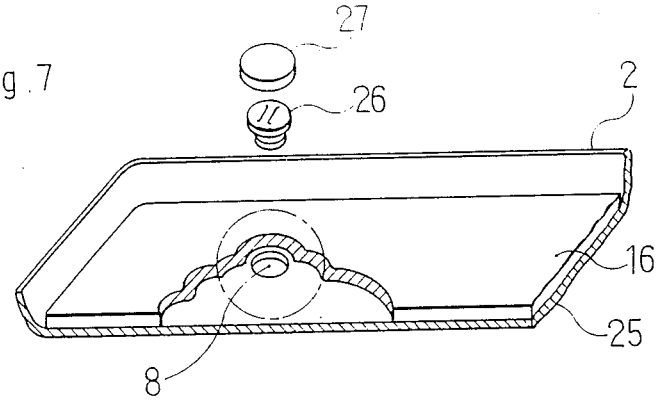
FIG. 7 is a partly cutout perspective view showing the state that a mattress is associated in the bathtub bed.
Figure 8:
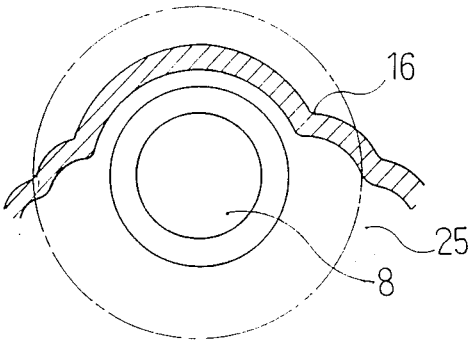
FIG. 8 is an enlarged perspective view of the drain hole of the bathtub bed in FIG. 7.
Figure 9:
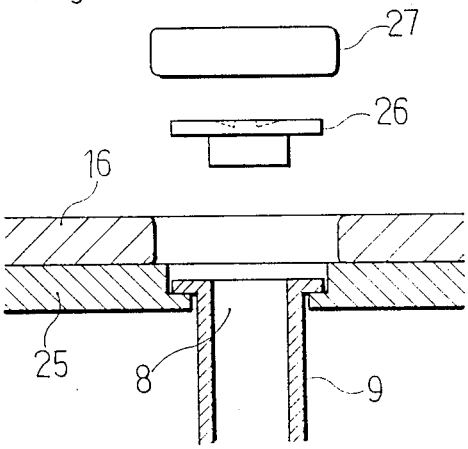
FIG. 9 is an enlarged sectional view showing the connected state of a drain tube at the bottom of the bathtub.
Figure 10:
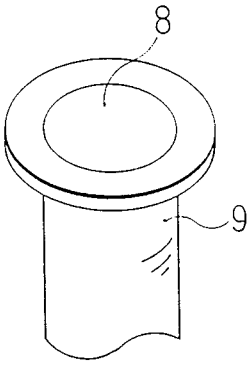
FIG. 10 is a perspective view showing the connecting end of the drain tube.
Figure 11:
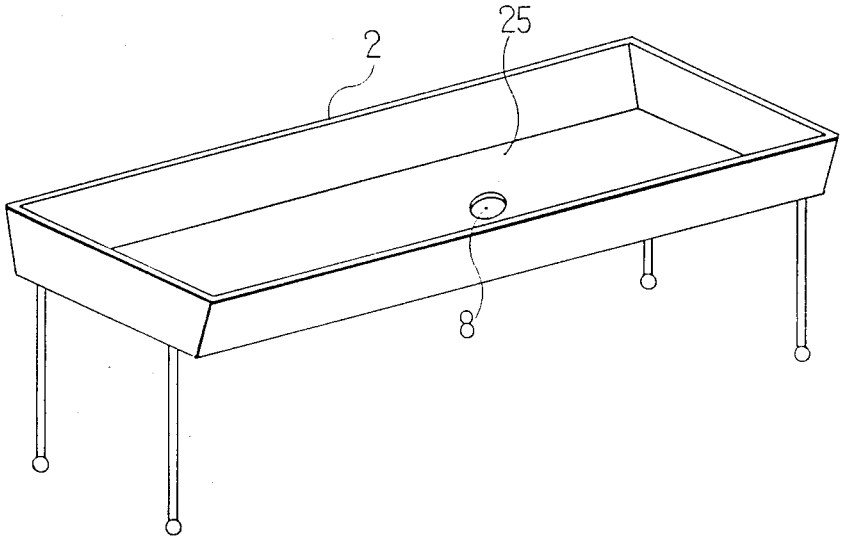
FIG. 11 is a perspective view of the bathtub bed in the state that the mattress is removed.

Reference numeral 1 denotes a box-shaped outer frame composed of synthetic resin plates which are strong against moisture at the upper portion and periphery thereof, in which a medical attendance bathtub bed 2 supported by four legs with wheels is provided therein for allowing a patient to be cured, to take a rest or have a bath, is disposed. As particularly shown in detail in FIG. 2, the bathtub bed 2 is so constructed that a patient body can have a bath in a laid state, and adapted to be formed of plastic such as vinyl chloride resin, or metal such as stainless steel or metal finished with enamel. A drain hole 8 is formed substantially at the center of the bathtub bottom 25 of the bathtub bed 2. The drain hole 8 is composed in a stepwise structure as shown in FIG. 7, and a drain tube 9 with its upper end formed with a flange is connected to the stepped portion of the drain hole 8. The lower end of the drain tube 9 is connected to a sewage hole 10. A drain plug 26 is detachably engaged with the drain hole 8 to block the drain hole 8 at the time of bathing. A mattress 16 is detachably disposed on the bathtub bottom 25, and constructed in a waterproofing structure in which its outside is covered with a waterproof cloth or synthetic resin film. A connection hole is formed at a position of the mattress 16 corresponding to the drain hole 8 of the bathtub bottom 25, and is normally closed by a mattress cover 27.

Reference numeral 3 denotes a hammock-shaped elevation net telescopic in the bathtub bed 2 for holding a patient's body, which is formed of cloth having a number of through pores for feeding water such as knitted or water repelling cloth containing no moisture. Both longitudinal ends of the elevation net 3 are coupled to the ends of U-shaped arms 5, as shown in FIGS. 1 to 5, and two positions of the horizontal portions of the arms 5, 5 are formed with nut 30 which are respectively clamped with normally or reversibly rotatable threaded rods 31 elevators 4, 4 disposed at the lower outside of the bathtub bed 2. A motor driver (not shown) is operated by the actuation of an elevation button 11 provided at the elevator 4 to normally or reversibly rotate the threaded rods thereto to vertically move upwardly or downwardly the front and rear arms 5, 5 synchronously, thereby vertically moving the elevation net 3 in a horizontal attitude.

Figure 12:
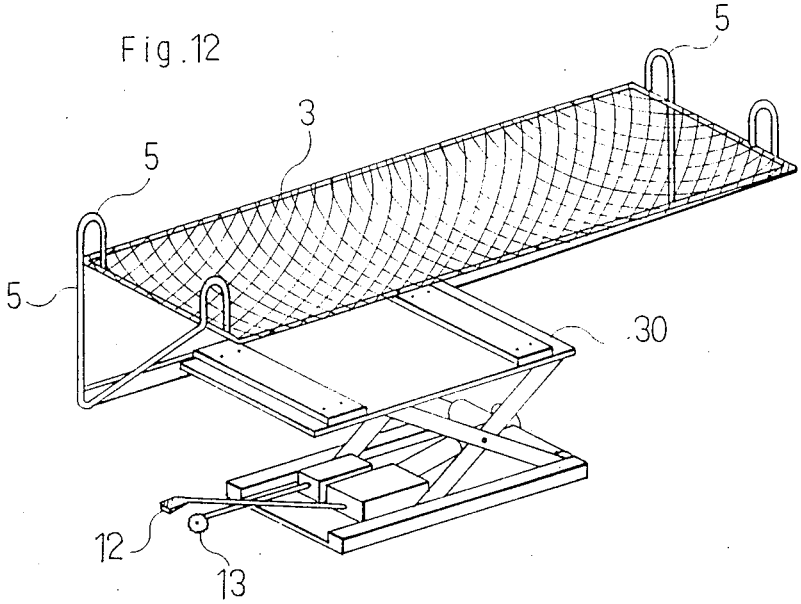
FIG. 12 is a partly cutout perspective view showing an elevator mechanism of an elevation net by a hydraulic elevator.
Figure 13:
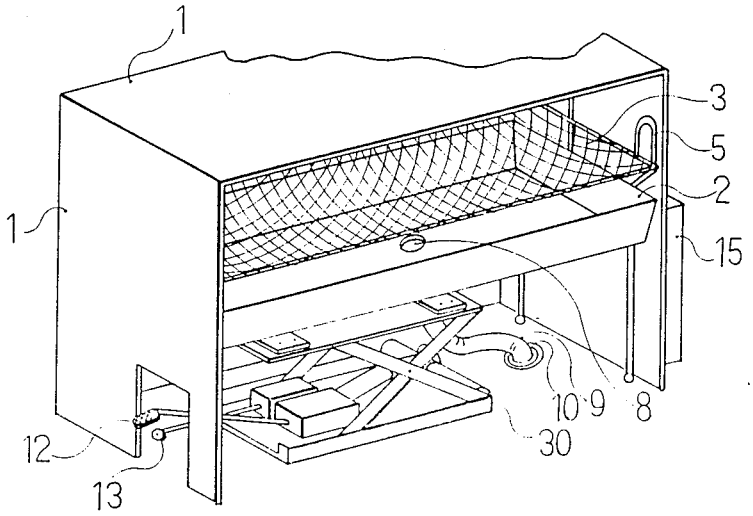
FIG. 13 is a partly cutout perspective view showing the state that the elevator of the elevator net shown in FIG. 12 is associated with the bathtub bed disposed in the outer frame.

FIGS. 12 and 13 show the case that a hydraulic actuation type elevator 30 different from the elevator 4 is employed. The elevator 30 supplies hydraulic oil to its plunger by pressing its pedal 12 to lift an upper face plate supported to the frame of a pantagraph structure in a horizontal attitude, thereby similarly lift the elevation net 3 through the arms 5, 5 supported to the upper face plate. The hydraulic oil in the plunger is removed by turning a cock knob 13 to lower the upper face plate in the horizontal attitude, thereby lowering the elevation net 3 similarly in the same manner. The pedal 12 and the cock knob 13 can be easily operated manually.

A hot water tank 15 is attached to one side of the outer frame 1, and a shower 6 is attached to the end of a hot water supply hole 7 connected to the hot water tank 15. Reference numeral 14 in FIG. 3 denotes a floating ring to be engaged with the patient's neck, and numeral 17 denotes a rubber pillow provided at the elevation net 3 to be used in case of bathing for safety. Further, openable sliding doors 18 are provided at the other side of the outer frame 1, closed as required to protect its inside privacy, and composed of a synthetic resin member having moisture resistance.

Figure 17:
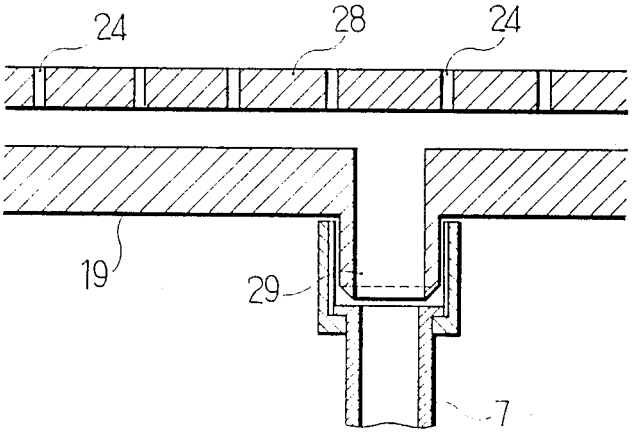
FIG. 17 is an enlarged sectional view of a connector of the detachable stool to a hot water supply hose.
Figure 18:
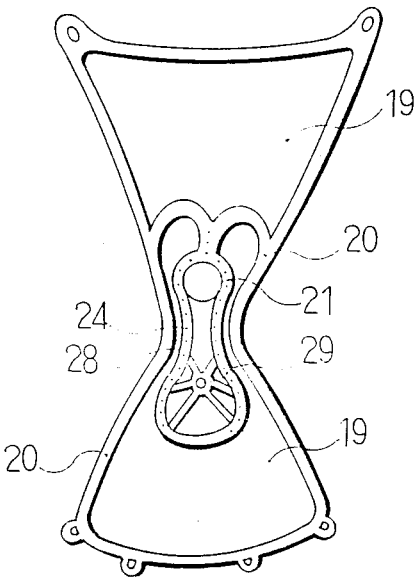
FIG. 18 is a plan view of the state that the detachable stool is developed.
Figure 19:
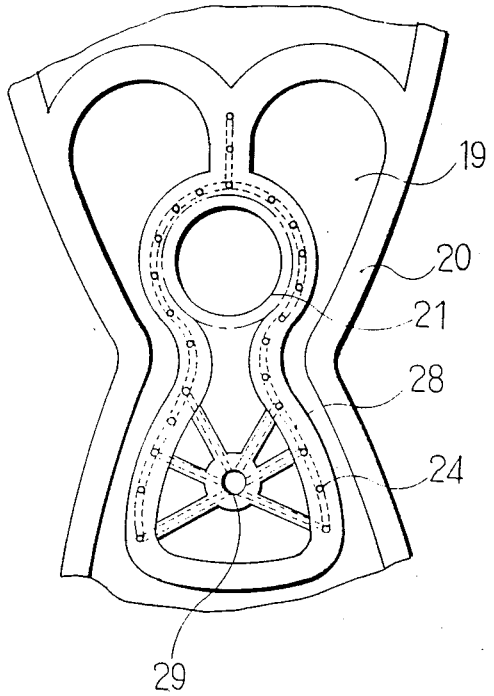
FIG. 19 is an enlarged plan view of a major portion of the detachable stool.
Figure 20:
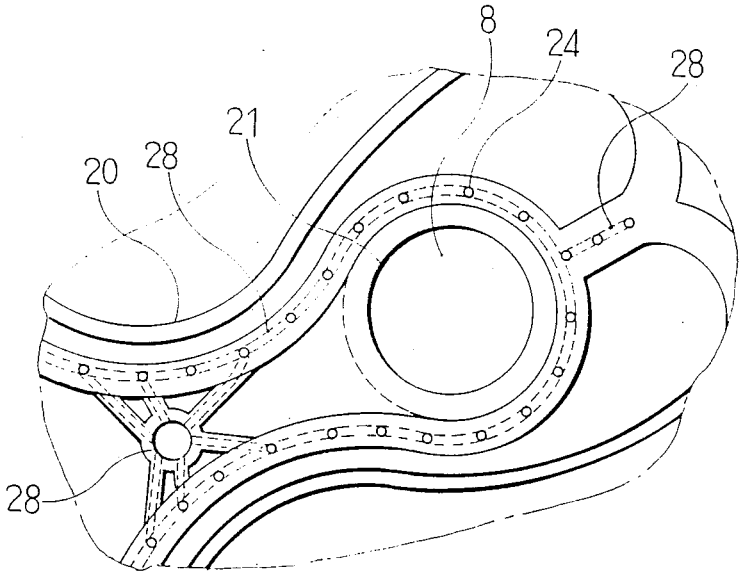
FIG. 20 is an enlarged plan view of the drain portion of the detachable stool.

Reference numeral 19 (in FIG. 14) denotes a detachable stool body with a shower form constructing a detachable stool, adapted to be manufactured by molding of flexible rubber. The detachable stool body 19 is so formed, as shown in FIGS. 14 to 20, with a neck portion at a portion corresponding to a waist portion to easily cover patient's pubic region and anus, formed with a suitable number of attachment holes at both longitudinal ends thereof, and respectively attached with coupling strings 22. A cleaning liquid drain section 21 is so provided as to protrude outwardly substantially at the center of the detachable stool body 19. When the detachable stool body 19 is attached to the patient laid on the bathtub bed 2, the drain section 21 is capable of connecting to the drain hole 8 of the bathtub bottom 25 through the connection hole of the mattress 16 presented by removing the mattress cover 27. As shown in FIGS. 18 to 20, a cleaning liquid injector 28 made of suitable number of injection holes 24 capable of injecting cleaning liquid to patient's pubic region and anus is provided on inside face of the detachable stool body 19. The injection holes 24 are so disposed as to surround the patient's pubic region and anus when it is attached to the patient's body. Further, as shown in FIG. 17, a cleaning liquid supply port 29 is formed at the detachable stool body 19, and connected to a cleaning liquid inlet passage internally provided in the hot water supply port 29 and the cleaning liquid injector 28. The cleaning liquid supplied from the hot water supply port 29 is fed though the cleaning liquid inlet passage and injected in a shower state from the injection holes 24. As shown in FIG. 17, the hot water supply port 29 can be attached with the hot water supply hose 7 from which the shower 6 is removed, and the cleaning liquid is supplied from the hot water supply hose 7 to the hot water supply port 29. It is noted that an exclusive use hot water supply equipment may be separately provided instead of the hot water supply hose 7 to supply hot water from a hot water supply hose to be attached thereto. A packing 20 of a softly attachable structure is so attached to the peripheral edge of the detachable stool body 19 as to cover the patient's pubic region and anus in a sealing state to eliminate the water leakage and air leakage. The packing 20 is mainly formed of vinyl chloride lather containing air or sponge therein.

Reference numeral 23 denotes hook fittings to be attached to the coupling strings 22 of the detachable stool body 19. The base ends of the hook fittings 23 are fixedly secured to the bathtub bed 2 to sufficiently bring the detachably stool body 19 attached to the patient's body laid on the bathtub bed 2 by pulling it into close contact therewith. The hook fittings 23 are so composed as to be elastically shrinkable and extensible in order to increase close contact and to cope with slight movement of patient's body. The detachable stool body 19 may be wound fixedly on the patient's body like the ordinary diaper.

The operation of the medical attendance bathtub bed constructed as described above will be described.

Figure 14:
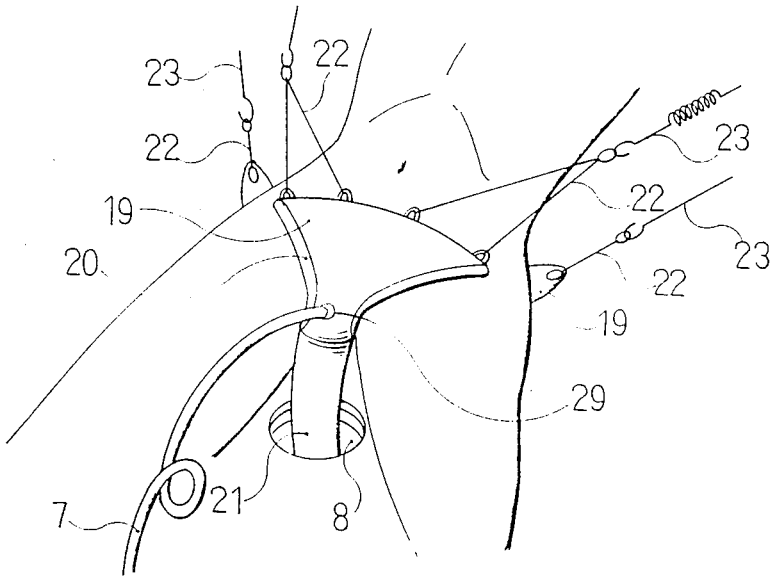
FIG. 14 is a perspective view showing the state that a detachable stool is attached to a predetermined position of a patient on the bathtub bed.
Figure 15:
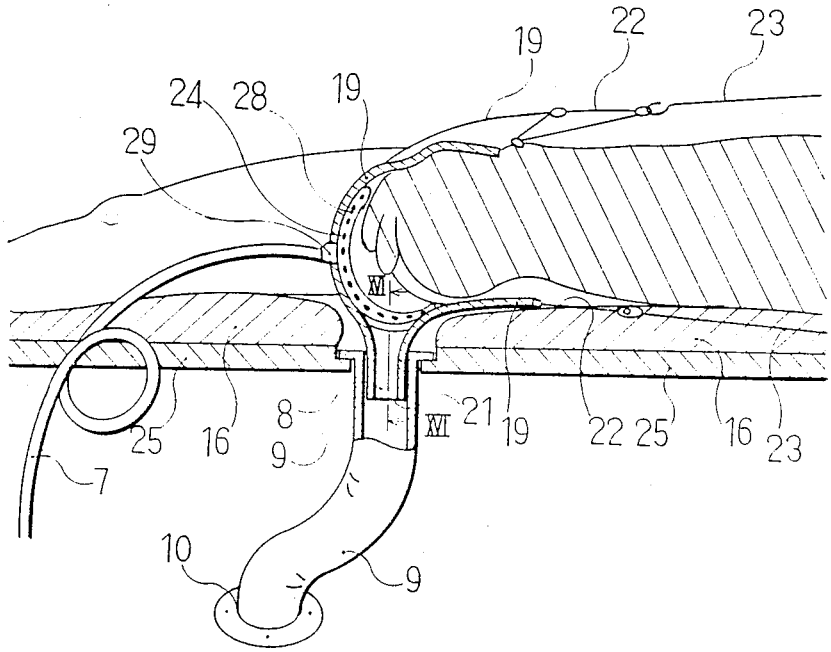
FIG. 15 is a sectional view of FIG. 14.
Figure 16:
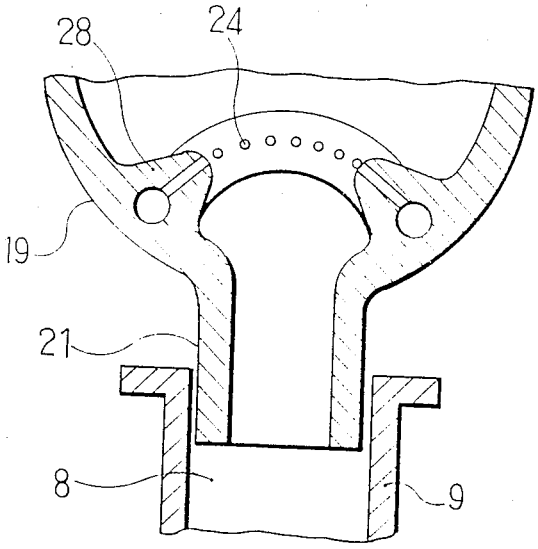
FIG. 16 is an enlarged sectional view taken along a line XVI—XVI in FIG. 15.

The mattress cover 27 covering the connection hole formed at the mattress 16 on the bathtub bed 2 is first removed, the patient's body is disposed backside to be laid thereon. Then, the detachable stool body 19 is so brought, as shown in FIGS. 14 and 15, into contact with the patient as to cover the patient's pubic region and anus, and the drain section 21 is connected to the drain hole 8 of the bathtub bottom 25 through the connection hole. The ends of the hook fittings 23 are respectively engaged with the coupling strings 22, and tightly engaged therewith. When the patient uses the stool in this state, since the patient's pubic region and anus are covered with the detachable stool body 19 with the packing 20, discharge sound and offensive odor are not externally leaked, and no unpleasant feeling is given to oneself and one's periphery.

After the stooling, cleaning liquid of suitable temperature is supplied to the detachable stool body 19 through the hot water supply port 29. Then, the cleaning liquid is injected in a shower state from the injection ports 24 of the cleaning liquid injector 28 to the patient's pubic region and anus and their peripheries to thereby clean these portions. The cleaning liquid injected and the contaminants are fed down to the drain tube 9 through the drain hole 8 from the drain section 21 without leaking to the exterior by the packing 10, and guided to the sewage hole 20. Accordingly, it is not necessary to carry contaminants after the stooling as in the conventional case, it is thus sanitary, and no offensive odor is externally leaked in the drain process.

After the cleaning work is finished, the hot water supply from the hot water supply hose is stopped, the coupling strings 22 are disengaged from the hook fittings 23, and the detachable stool body 19 is removed from the patient's body. Since the detachable stool body 19 is also cleaned with the cleaning liquid during the cleaning work, there is no inconvenience of handling it. Then, the moistened portion of the patient's body is wiped to be dried by a hot air blower or the like, and worn with clothing. If necessary, the detachable stool body 19 is again attached to the patient's body, and the stool body is worn on the patient. According to this method, not only male but female patient's pubic region can be cleaned to protect the patient's body against various female specific diseases, and it is effective for piles irrespective of male and female patients.

Figure 1:
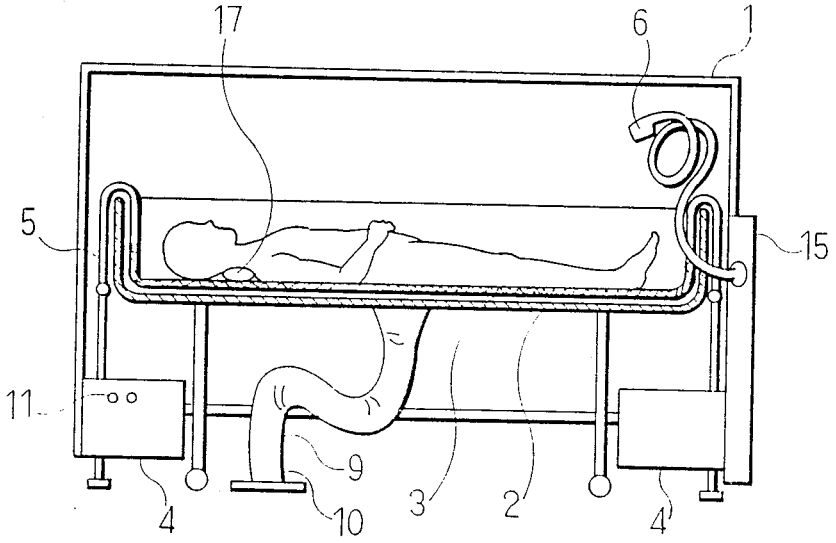
FIG. 1 is a partly cutout front view showing an embodiment of a medical attendance bathtub bed in the state that a person body is laid on an elevation net fallen down on the bathtub bed according to the present invention.

When the patient has a bath after stooling, as shown in FIG. 1, the hot water supply hose 7 is removed from the hot water supply port 29, the detachable stool body 19 is separated, and the shower 6 is instead attached thereto. Then, the bathtub bed 2 is introduced into the outer frame 1, and the elevation net 3 is lowered by the elevators 4, 30 on the mattress 16. Thereafter, after the patient's body is laid on the elevation net 3 in the state that the detachable stool body 19 is removed, the elevation net 3 is lifted to hold the patient's body in a suspended state. Subsequently, the mattress 16 is removed from above the bathtub bed 2, and hot water is supplied from a hot water tube (not shown) from the hot water tank 15 into the bathtub bed 2. As required, the interior in the outer frame 1 is heated by the hot air blower, a hot beam implement, etc. After the hot water supply is finished, the elevation net 3 is lowered to allow the patient's body to have a bath in the bathtub bed 2. In this case, the floating ring 14 is engaged with the patient's neck, and the rear portion of the patient's head is placed on the rubber pillow 17 for safety.

After the patient's bathing is finished, the floating ring 14 is removed, the drain plug 26 is removed, and the hot water is drained to the sewage hole 10 through the drain hole 8 and the drain tube 19. At the same time, the hot water is applied to the patient's body by the shower 6, the elevation net 3 is then again lifted, to lift the patient's body in a suspended state, the moisture on the patient's body, in the bathtub bed 2 and the elevation net 3 is wiped, and, as required, dried by a hot air blower or the like. During this period, the drain plug 26 is engaged with the drain hole 8 to block it, and the mattress 16 is returned into the bathtub bed 2. Then, the elevation net 3 is lowered for the mattress 16 to be placed on the patient's body.

As described above, when the patient needs a bath, it is not necessary to carry the patient or old person to a bath. Accordingly, only one nurse or attendant may be sufficient for allowing the patient to have a bath. Further, since no human power is required to lift or lower the patient's body, the attendant's fatigue is remarkably reduced as compared with lifting a patient into and out of a conventional bathtub, and it can allow the patient to frequently have a bath thereby the patient's body can always be clean, thereby eliminating the patient's offensive odor and efficiently treating the patient in a short period of time. Since the bathtub bed 2 can be used as both a bath and bed as well as be solely removed from the outer frame 1 irrespective of the elevator 4, it can be easily replaced with another bathtub bed on which a mattress is already laid, a medical care bed, or other various bed for different use, and it is hence easy to leave the frame 1 after bathing. Since this bathtub bed can replace the bathing with the stooling treatment only by replacing the shower 6 with the detachable stool body 19 at the end of the hot water supply hole 7, it is very convenient.

What is claimed is:

1. A medical attendance bathtub bed for use with a detachable mattress comprising:

(a) a bathtub having a hot water drain hole in the bottom thereof and a drain tube connected thereto;

(b) bathtub supporting means;

(c) a detachable stool body in said bathtub and including means for sealingly covering a person's public and anus regions;

(d) injector means provided inside said stool body for injecting a mixture of cleaning liquid and hot water to person's public and anus regions;

(e) said stool body having a cleaning liquid and hot water drain section, said drain section having an outlet conduit connected to said drain hole formed in said bathtub bottom; and (f) means for supplying cleaning liquid and hot water to said injector means.

2. A medical attendance bathtub bed having a hot water a detachable mattress comprising:

(a) a bathtub having a hot water drain hole in the bottom thereof and a drain tube connected thereto;

(b) a net disposed in said bathtub for holding, lifting and lowering a patient's body;

(c) net elevation means for vertically lifting or lowering said net;

(d) a detachable stool body in said bathtub and including means for sealingly covering a person's public and anus regions;

(e) injector means provided inside said stool body for injecting a mixture of cleaning liquid and hot water to the person's public and anus regions;

(f) said stool body having a cleaning liquid and hot water drain section, said drain section having an outlet conduit connected to said drain hole formed in said bathtub bottom;

(g) means for supplying cleaning liquid and hot water to said injector means, and (h) supporting means for supporting said bathtub.

* * * * *